US005655764A

United States Patent [19]

Ota et al.

[11] Patent Number: 5,655,764

[45] Date of Patent: Aug. 12, 1997

[54] PAPER CASSETTE AND PRINTER THEREWITH

[75] Inventors: Yukio Ota; Hidenori Ueda, both of Tokyo, Japan

[73] Assignee: Oki Electric Industry Co., Ltd., Tokyo, Japan

[21] Appl. No.: 498,816

[22] Filed: Jul. 6, 1995

[30] Foreign Application Priority Data

Jul. 22, 1994 [JP] Japan ..... 6-171060

[51] Int. Cl.[6] ..... B65H 1/00

[52] U.S. Cl. ..... 271/171

[58] Field of Search ..... 271/171, 9.06

[56] References Cited

U.S. PATENT DOCUMENTS 4,697,803 10/1987 Kan et al. ..... 271/171 X

FOREIGN PATENT DOCUMENTS 60-56741 5/1985 Japan ..... 271/171

63-185730 8/1988 Japan ..... 271/171

187431 3/1989 Japan ..... 271/171

*Primary Examiner*—David H. Bollinger

*Attorney, Agent, or Firm*—Panitch Schwarze Jacobs & Nadel, P.C.

[57] ABSTRACT

A paper guide is movably disposed on a paper cassette according to the present invention. One edge of a link member is rotatably pivoted on a paper rear edge guide. A gear is formed on a pivoting side of the arm member. The gear is engaged with a gear formed on a signal output drum disposed in the paper cassette. As the paper guide is moved, one train of protrusions corresponding to the size of papers stored in the paper cassette is selected. A printer to which the paper cassette is attached according to the present invention has switches that are pressed by the selected train of protrusions. The switches detect the sizes of papers stored in the paper cassette.

13 Claims, 14 Drawing Sheets

PAPER CASSETTE AND PRINTER THEREWITH

BACKGROUND OF THE INVENTION

1. Field of the Invention

The present invention relates to the construction of a paper cassette and the construction of a printer therewith, in particular to, the construction of a paper cassette for moving a paper guide to a paper storing position corresponding to the size of stored paper and the construction of a printer therewith.

2. Description of the Related Art

In a paper cassette that can store a plurality of sizes of papers, a paper guide that is a restricting member for restricting the storing position of the papers corresponding to the size thereof is disposed. A conventional paper guide is constructed of a guide member for restricting the longitudinal feeding direction of the papers and another guide member for restricting the lateral feeding direction of the papers. However, the conventional paper cassette does not have a means for outputting position information of the paper guide that is secured corresponding to the size of papers to a printer. Thus, the user should input the size information of the stored from the operation panel of the printing apparatus. Consequently, the operability of the conventional printer is not high.

SUMMARY OF THE INVENTION

An object of the present invention is to provide the construction for allowing the size of papers stored in a paper cassette to be automatically output without necessity of user's intervention, thereby improving the operability of the printer.

To accomplish the above object, the present invention is a paper cassette, comprising a frame for stacking papers, a paper guide movably mounted at the frame corresponding to the size of the stored papers, a signal output portion, and a transmitting means for transmitting the position of the paper guide to the signal output portion, wherein the signal output portion is adapted for outputting a paper size signal corresponding to the stored papers corresponding to position information of the paper guide transmitted by the transmitting means.

In addition, the present invention is a printer with the paper cassette, comprising a signal detecting means for detecting the paper size signal that is output from the signal output portion when the paper cassette is attached to the printing unit, and a determining means for determining the size of the papers stored in the paper cassette corresponding to the signal detected by the signal detecting means.

These and other objects, features and advantages of the present invention will become more apparent in light of the following detailed description of best mode embodiments thereof, as illustrated in the accompanying drawings.

DESCRIPTION OF PREFERRED EMBODIMENTS

Next, preferred embodiments of the present invention will be described.

(First Embodiment)

Figure 2:
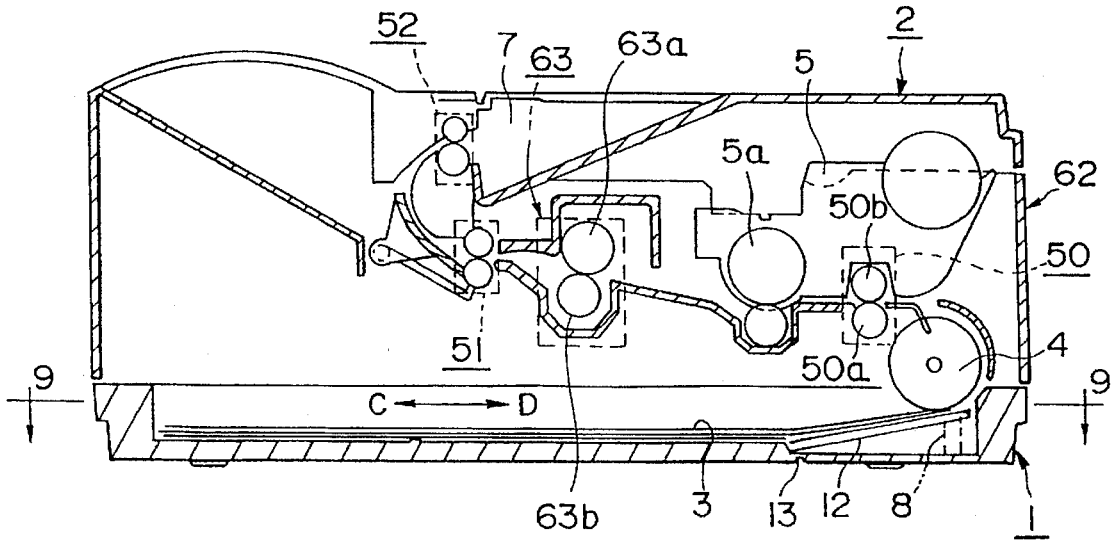
FIG. 2 is an outlined sectional view showing the printer according to the embodiment.
Figure 3:
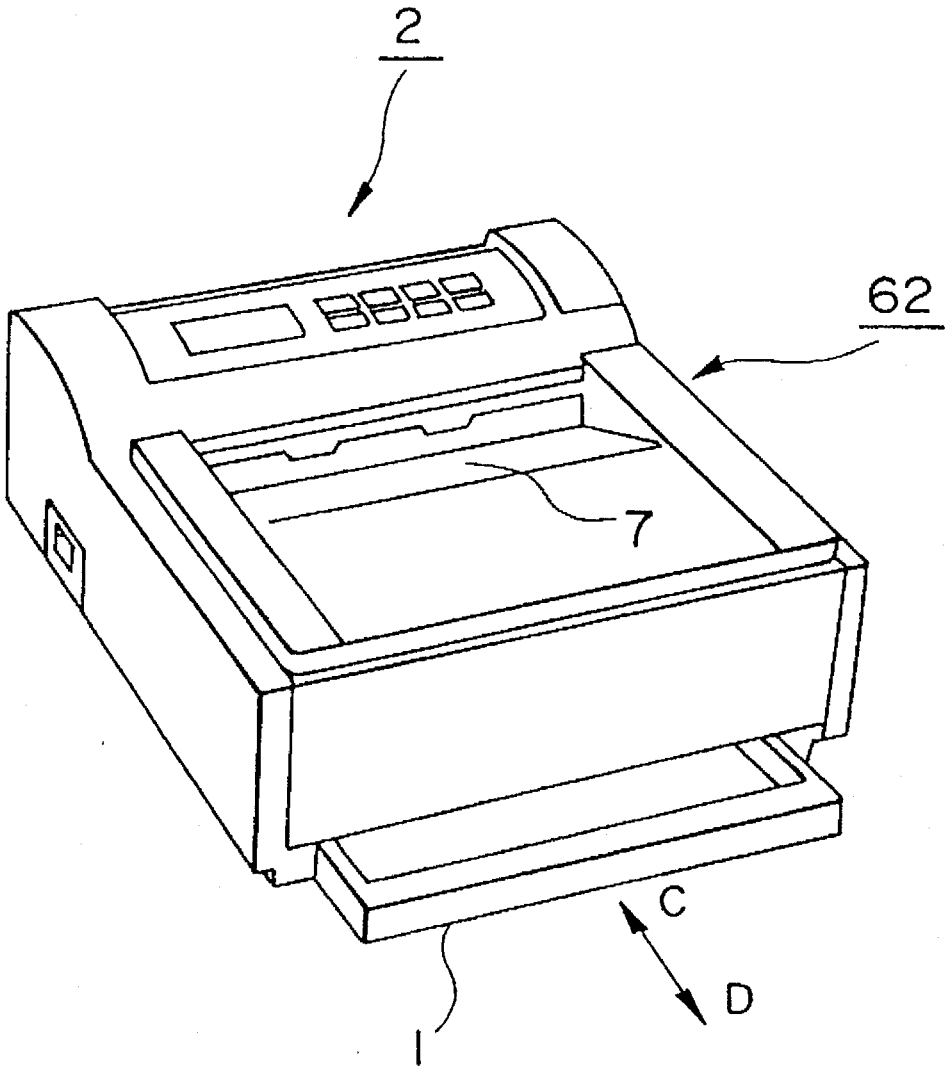
FIG. 3 is an external perspective view showing the printer.

With reference to FIGS. 2 and 3, the construction of a printer that uses a paper size detecting mechanism according to the present invention will be described in brief.

The printer 2 is constructed of a main unit 62 and a detachable paper cassette 1. The main unit 62 comprises a paper feed roller 4, a pair of conveying rollers 50, an electrophotographic unit 5, a fixing unit 63, a pair of unloading rollers 51 and 52, and an unloading stacker 7.

Next, the constructional portions of the printer will be described in detail.

The paper cassette 1 can store papers of three sizes that are A5, letter (referred to as LET), and A4. In addition, the paper cassette 1 has a spring 8 and a paper stacking plate 12. The spring 8 is disposed on the side of the paper feed roller 4. The paper stacking plate 12 is pushed up by the spring 8. When the paper cassette 1 is attached to a bottom portion of the main unit 62, the papers placed on the paper stacking plate 12 are pressured to the paper feed roller 4 by the spring 8. The paper feed roller 4 is rotatably pivoted by the main unit 62. In addition, the paper feed roller 4 is rotated by a drive source (not shown) in such a manner that the papers 3 are fed to the main unit 62 one by one. The pair of conveying rollers 50 are a feed roller 50*a* and a pressure roller 50*b*. The feed roller 50*a* and the pressure roller 50*b* are rotatably pivoted by the main unit 62. The pressure roller 50*b* is pressured to the feed roller 50*a* by a tension means (not shown). The feed roller 50*a* is driven by a drive source (not shown). A paper that is fed by the paper feed roller 4 is conveyed to the electrophotographic unit 5 in association with the pressure roller 50*b*. The electrophotographic unit 5 is constructed of a photosensitive drum 5*a*, a cleaning roller (not shown), a charging roller (not shown), a developing roller (not shown), and a supporting member (not shown). The cleaning roller, the charging roller, and the developing roller are disposed in the vicinity of the photosensitive drum 5*a*. The supporting member integrally supports the photosensitive drum 5*a* and these rollers. The electrophotographic unit 5 transfers a toner image to a paper 3 fed from the paper feed roller 4. The fixing unit 63 is constructed of a fixing roller 63*a* and a backup roller 63*b* that is pressured thereto by a particular means (not shown). The fixing unit 63 fixes the toner image transferred to the paper 3 by heat generated from a heat source (not shown) in the fixing roller 63*a* and the pressure of the backup roller 63*b*. The pair of unloading rollers 51 and 52 are unloading rollers that unload the paper on which the toner image has been fixed to the outside of the printer. The pair of unloading rollers 51 and 52 are rotated by a drive source (not shown). The unloading stacker 7 is a stacker that stacks and holds papers that have been printed.

Next, the construction of the paper cassette 1 that can store papers of a plurality of sizes will be described in detail.

Figure 1:
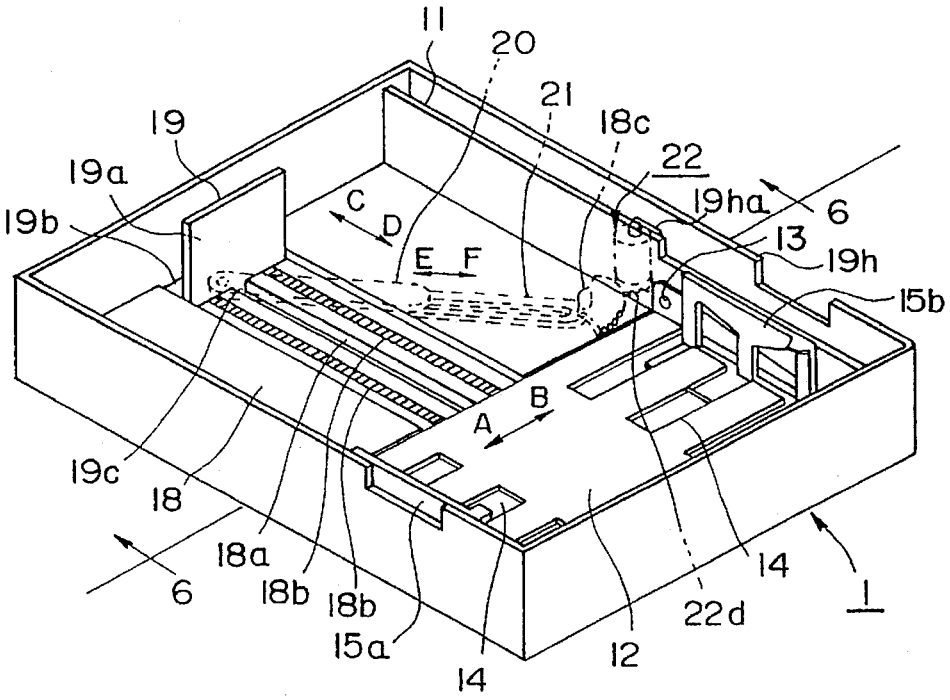
FIG. 1 is a perspective view showing a paper cassette attached to a printer according to a first embodiment of the present invention.
Figure 9:
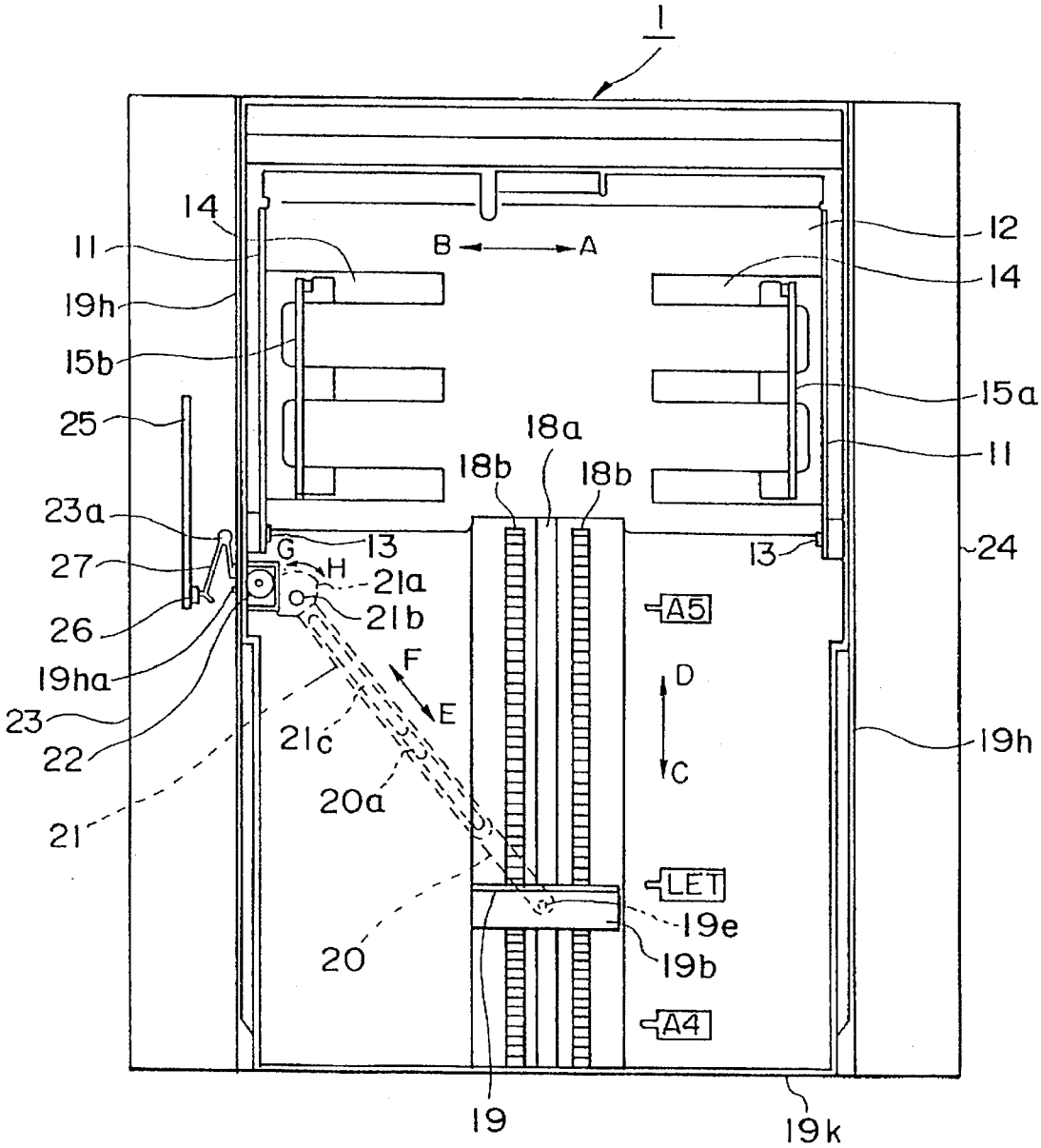
FIG. 9 is a sectional view almost taken along line P—P of FIG. 1.

Referring to FIG. 1 that is a perspective view showing the paper cassette 1 and FIG. 9 that is a sectional view of the paper cassette 1 that is attached to the main unit 62, the paper stacking plate 12 is disposed on a pair of inside frames 11 that are disposed oppositely in the directions of arrows A and B in such a manner that the paper stacking plate 12 is rotated by a pair of shafts 13. The paper stacking plate 12 has opening portions 14. Paper side guides 15*a* and 15*b* that restrict side portions of the feeding direction (the direction of arrow D) of the papers 3 are disposed in the opening portions 14. The paper side guides 15*a* and 15*b* are guided by the opening portion 14 so that the paper side guides 15*a* and 15*b* are moved in the directions of arrows A and B.

Figure 5:
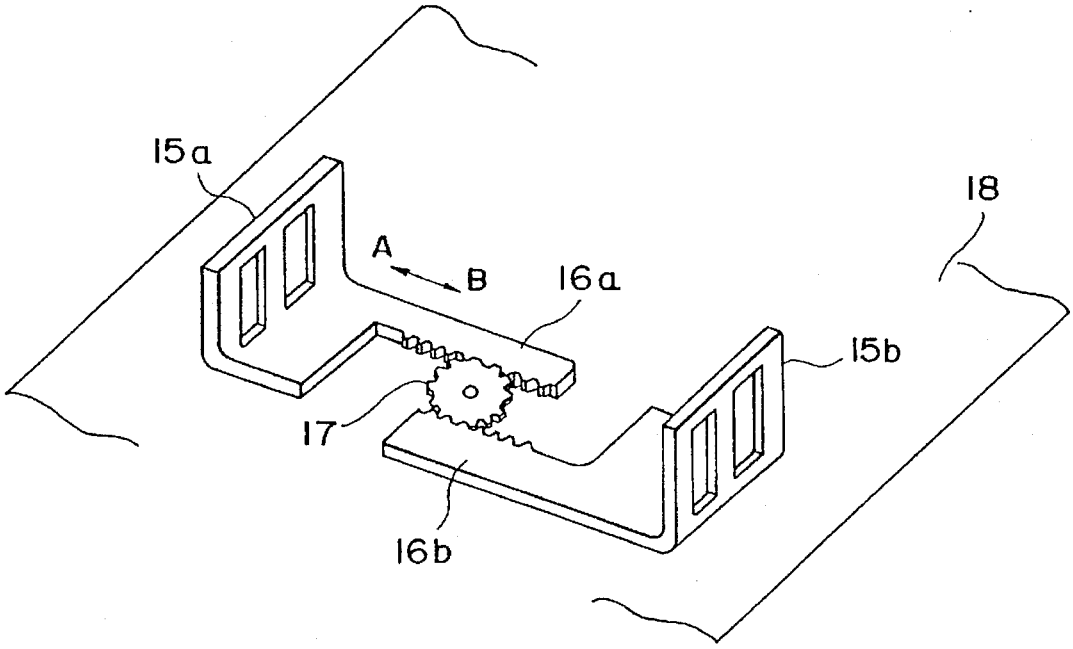
FIG. 5 is a perspective view showing a paper side guide.

Next, with reference to FIG. 5, a paper storing mechanism of the paper side guides 15*a* and 15*b* of the paper cassette 1 will be described. The paper side guides 15*a* and 15*b* have racks 16*a* and 16*b*, respectively. The racks 16*a* and 16*b* are engaged with a pinion 17. The pinion 17 is rotatably mounted on a bottom frame 18 of the paper cassette 1. Thus, the paper side guides 16*a* and 16*b* can be moved reversely from the center of the paper cassette 1 so as to restrict the papers in such a manner that the center of the lateral direction of the papers accords with the center of the paper cassette 1 corresponding to the size of the width of the papers 3.

Figure 6:
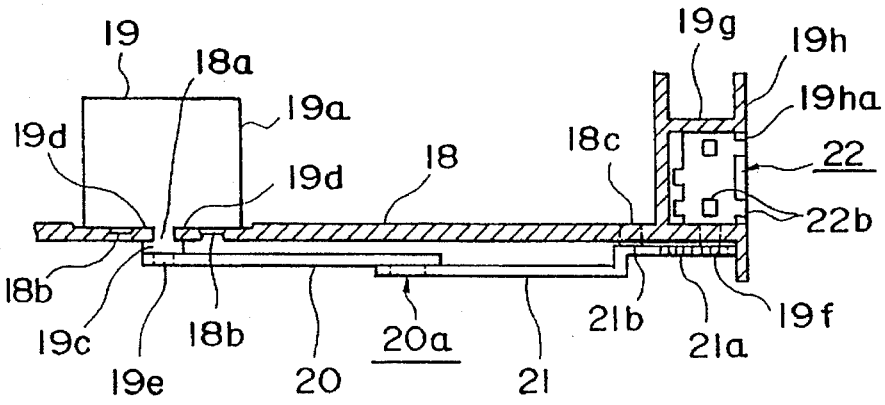
FIG. 6 is a partially enlarged sectional view almost taken along line N—N of FIG. 1.
Figure 7:
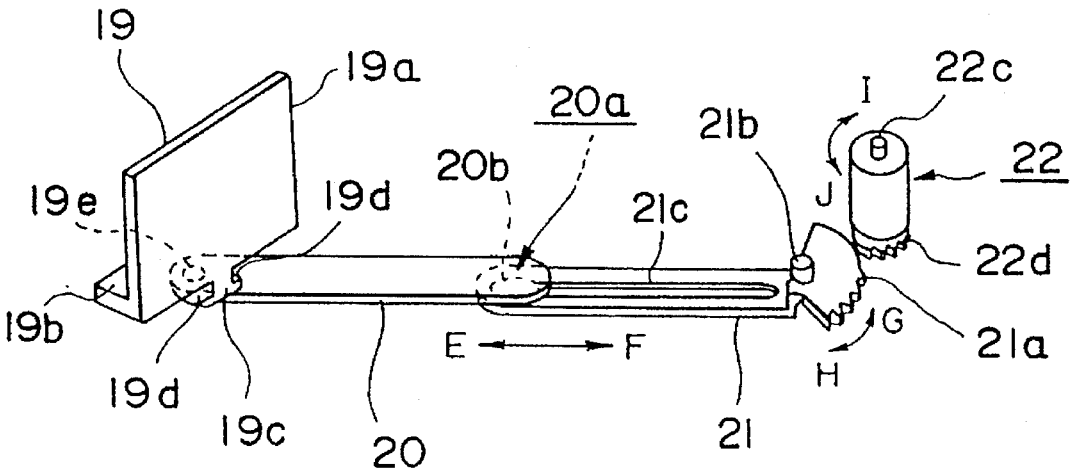
FIG. 7 is a perspective view for explaining the construction of the connection between a link member and an arm member.

As shown in FIGS. 1 and 9, a paper rear edge guide 1 is disposed on the bottom frame 18 of the paper frame so that the paper rear edge guide 19 can be moved in the directions of arrows C and D. Next, with reference to FIGS. 6 and 7, the paper rear edge guide 19 will be described. The paper rear edge guide 19 is constructed of a vertical wall 19*a*, a bottom plate 19*b*, and a guide frame 19*c*. A slide groove 19*d* is formed in the guide frame 19*c*. The slide groove 19*d* is slidably fit to a guide groove 18*a* formed in the bottom frame 18. Thus, the paper rear edge guide 19 can be linearly moved in the directions of arrows C and D. A protrusion is formed on the lower surface of the bottom plate 19*b* so that the protrusion is fit to a detente groove 18*b* formed in the bottom frame 18 of the paper cassette 1. As a result, the paper rear edge guide 19 can be secured at any position. A shaft 19*e* is disposed on the lower surface of the guide frame 19*c*. One edge of the link member 20 is rotatably fit to the shaft 19*e*. An elliptic protrusion 20*a* having a straight portion 20*b* shown in FIG. 7 is formed in the other edge of the link member 20. The link member 20 is connected to an arm member 21 (that will be described later).

The arm member 21 has a longitudinal guide groove 21*c*. The elliptic protrusion 20*a* formed on the link member 20 is slidably fit to the guide groove 21 in the directions of arrows E and D. A fan shaped gear 21*a* is formed at one edge of the arm member 21. A rotating shaft 21*b* is disposed at the center of the rotation of the fan shaped gear 21*a*. The rotating shaft 21*b* is rotatably fit to a bearing hole 18*c* formed in the bottom frame 18 of the paper cassette 1. The fan shaped gear 21*a* is engaged with a gear 22*d* of a signal output drum 22 (that will be described later).

Figure 8:
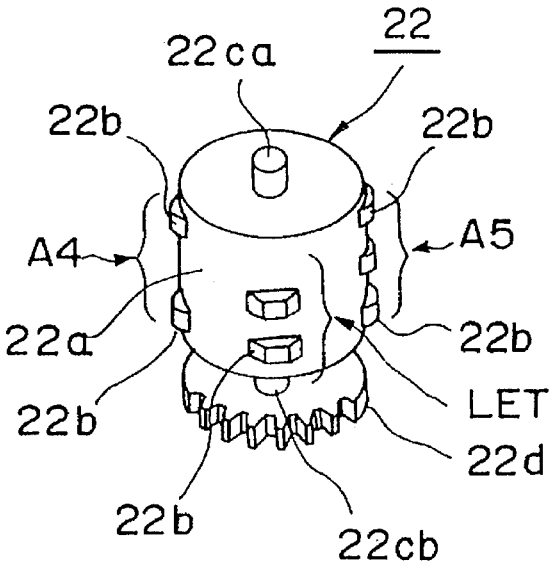
FIG. 8 is an exploded enlarged perspective view showing a signal output drum according to the embodiment.

In FIG. 8, rotating shafts 22*ca* and 22*cb* are disposed on the signal output drum 22. The rotating shaft 22*cb* has the above-mentioned gear 22*d*. The rotating shafts 22*ca* and 22*cb* are rotatably fit to both a bearing hole 19*f* formed in the bottom frame 18 shown in FIG. 6 and a bearing hole 19*g* formed in the inside frame 11. An outer peripheral surface of a cylindrical portion 22*a* is divided into areas corresponding to the number of outputs in the direction of the rotating shaft 22*c*. In this embodiment, the outer peripheral surface is divided into three areas. In the three areas, there are three trains of protrusions in the direction of the rotating shaft 22*c*. When the paper rear edge guide 19 is moved and secured at a predetermined position, one of trains of the protrusions 22*b* of the output signal drum 22 corresponding to the position of the paper rear end guide 19 is exposed from a window portion 19*ha* of an outside frame 19*h* as shown in FIG. 6.

Next, with reference to FIG. 6 that is a partially enlarged sectional view, a mechanism of the main unit 62 for detecting protrusions 22*b* of the signal output drum 22 exposed from the window portion 19*ha* will be described.

Figure 10:
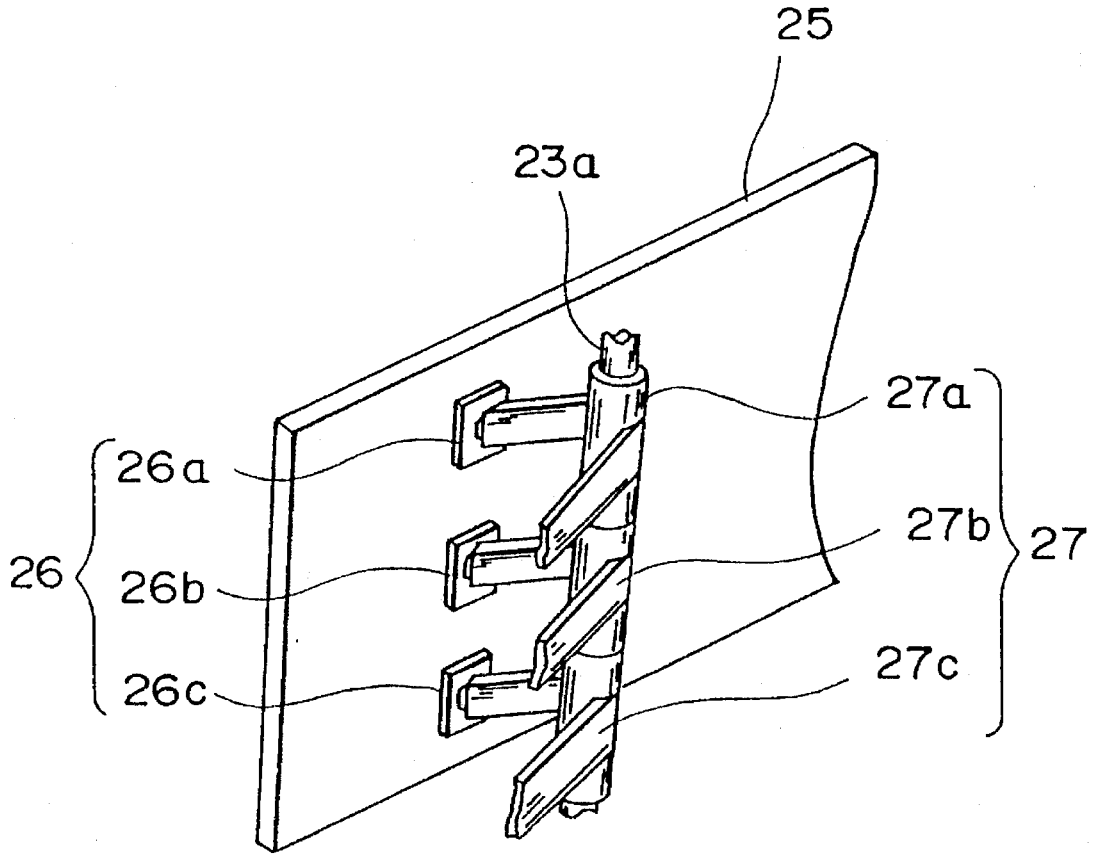
FIG. 10 is a partially enlarged perspective view showing a detecting lever and a switch according to the first embodiment.

As shown in FIG. 9, when the paper cassette 1 is attached to the main unit 62, the paper cassette 1 is held by side frames 23 and 24. A control board 25 is disposed on the side frame 23 on the side of the main unit 62. In FIGS. 9 and 10, three switches 26 (26*a*, 26*b*, and 26*c*) are disposed on the control board 25 in the direction of the rotating shafts 22*ca* and 22*cb* of the signal output drum 22. A fulcrum shaft 23*a* is disposed on the left side frame 23. Three vertical detecting levers 27 (27*a*, 27*b*, and 27*c*) are rotatably disposed on the fulcrum shaft 23*a*. When the paper cassette 1 is attached to the printer 2, protrusions 22*b* of the signal output drum 22 come in contact with edges of the detecting levers 27. When a protrusion 22*b* comes in contact with one of the detecting levers 27*a*, 27*b*, and 27*c*, the detecting lever is rotated about the fulcrum shaft 23*a*, thereby pressing the corresponding switch. When the switches 26*a*, 26*b*, and 26*c* are pressed, corresponding signals are output to a printer control portion disposed on the control board 25.

Figure 4:
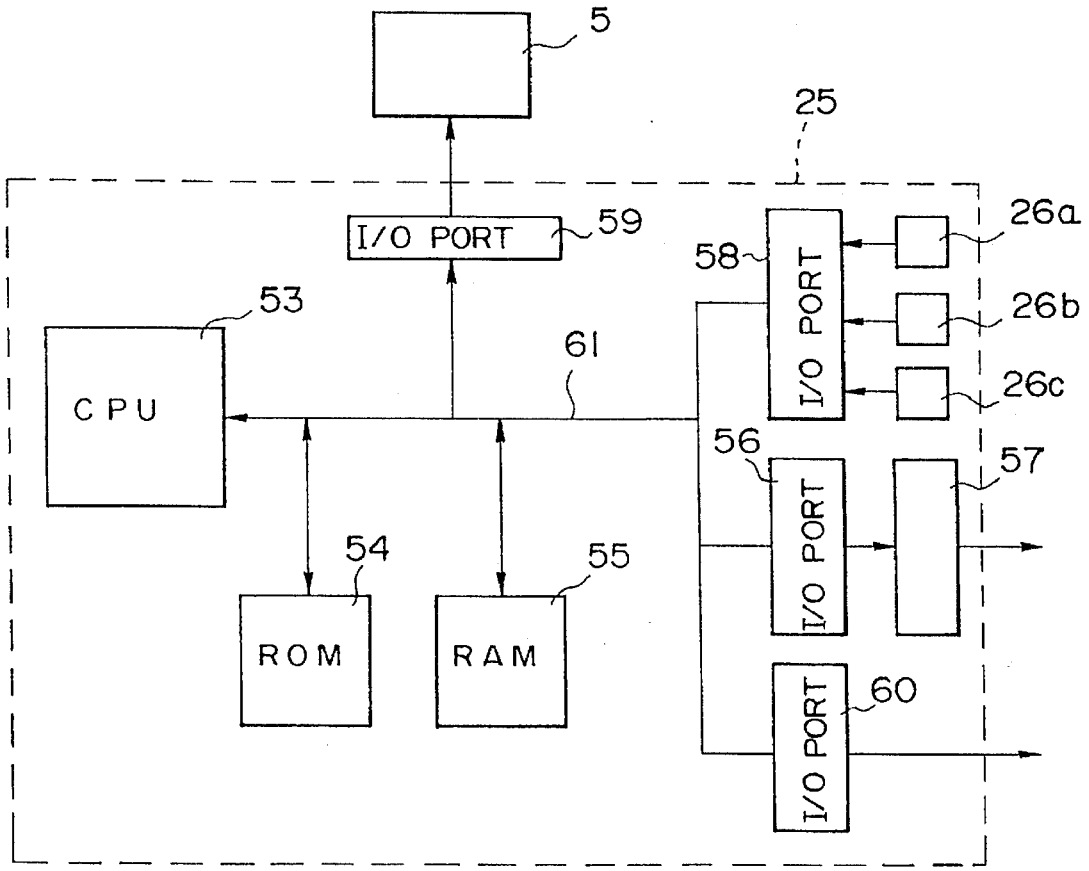
FIG. 4 is a block diagram showing a control portion according to the embodiment.

Next, with reference to FIG. 4, the construction of the control portion disposed in the main unit 62 will be described. In FIG. 4, the control board 25 has a control portion that controls the entire operation of the printer 2. The control board 25 comprises a CPU (Central Processing Unit) 53, a ROM (Read Only Memory) 54, a RAM (Random Access Memory) 55, input/output (I/O) ports 56, 58, 59, and 60, a motor driver 57, and switches 26*a*, 26*b*, and 26*c*. The CPU 53 controls the control operation of the control board 25. The ROM 54 stores programs that the CPU 53 executes and various data. The RAM 55 temporarily stores data. The motor driver 57 is controlled by the CPU 53 through the I/O port 56. The switches 26*a*, 26*b*, and 26*c* are connected to the CPU 53 through the I/O port 58. Each of these constructional portions is connected by a common bus 61. The I/O port 59 is connected to the printing (electrophotographic) unit 5 so that the I/O port 59 outputs print data to the printing unit 5. The I/O port 60 is connected to a switch (not shown) that determines whether or not the paper cassette 1 has been attached to the main unit 62 shown in FIG. 2. The switch outputs a signal that represents that the cassette 1 has been attached to the main unit 6 to the CPU 53.

The control portion compares the combination of signals that are output from the switches 26*a*, 26*b*, and 26*c* connected to the CPU 53 through the I/O port 58 with the combination of signals (see Table 1) stored in a predetermined area of the ROM 54 so as to determine the size of papers stored in the paper cassette 1.

TABLE 1

| | Paper size | | |
|---|---|---|---|
| Switch | A4 | LET | A5 |
| Switch 26a | ON | OFF | ON |
| Switch 26b | OFF | ON | ON |
| Switch 26c | ON | ON | ON |

Figure 11:
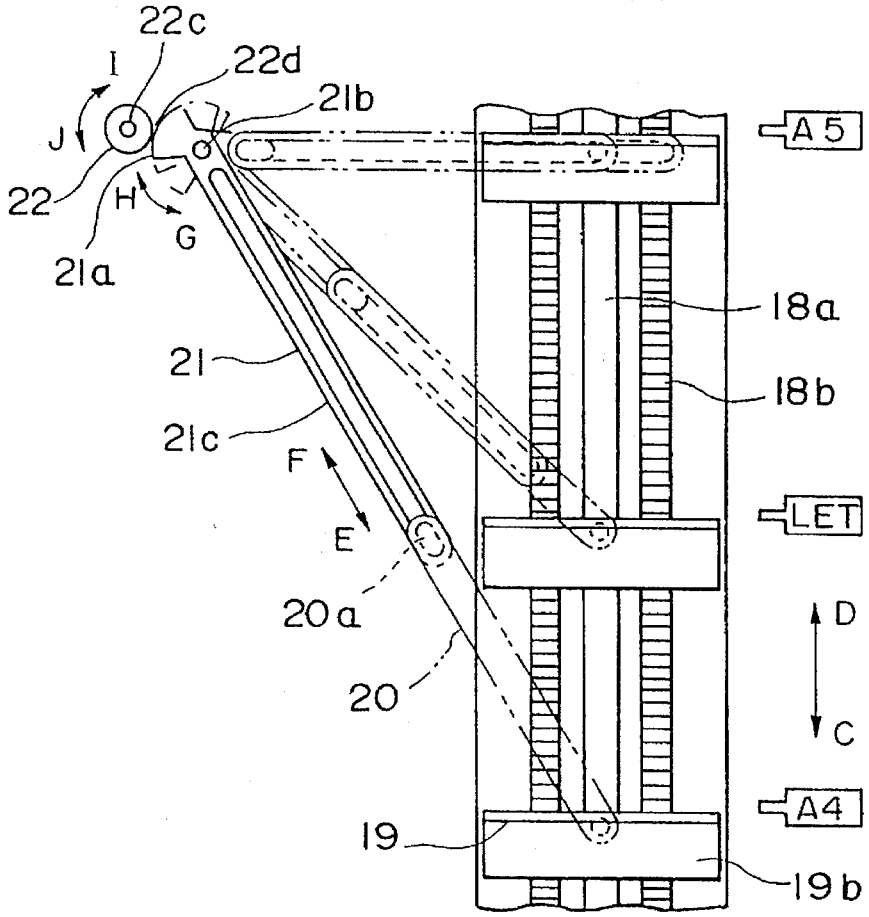
FIG. 11 is a schematic diagram for explaining the operation of a paper rear edge guide according to the first embodiment.

Next, the operation for determining the size of the papers stored in the paper cassette will be described in addition to the operation for storing the papers in the above-describe paper cassette and the operation for attaching the paper cassette to the printer with reference to FIG. 11.

First, the operation for storing the papers of A4 size in the paper cassette will be described. The papers of A4 size (not shown) are stored in the paper cassette in the condition that the paper rear edge guide 19 is placed in the "A4" paper storing position. Thereafter, the paper side guides 15*a* and 15*b* are moved so that they come in contact with the side edges of the papers. Since the paper rear edge guide 19 is placed in the "A4" paper storing position, an "A4 protrusion train" that are the first and third top protrusions shown in FIG. 8 is exposed from the outside frame 19*ha*. Thus, when the paper cassette 1 is attached to the printer 2, the train of exposed protrusions 22*b* causes edges of the detecting levers 27*a* and 27*c* corresponding to the train of the protrusions 22*b* to be pressed toward the control board 25, thereby rotating the detecting levers 27*a* and 27*c* about the fulcrum shaft 23*a*. Thus, the other edges of the detecting levers 27*a* and 27*c* press the switches 26*a* and 26*c*, respectively. The switches 26*a* and 26*c* output signals to the CPU 53 through the I/O port 58. The CPU 53 compares the combination of these signals with the combination of signals stored in a predetermined area of the ROM 54 and determines that the size of the papers stored in the paper cassette 1 is A4.

When papers of LET size are stored in the paper cassette 1, the paper side guides 15*a* and 15*b* are moved so that they come in contact with the side edges of the papers. In addition, the paper rear edge guide 19 is moved from the A4 position in the direction of arrow D. As the paper edge guide 19 is moved in the direction of arrow D, the link member 20 and the arm member 21 are rotated in the direction of arrow G. Thus, the elliptic protrusion 20*a* of the link member 20 is moved in the direction of arrow F along the guide groove 21*c*. At this point, since the straight portion 20*b* of the elliptic protrusion 20*a* is fit to the guide groove 21*c*, the relation between the link member 20 and the arm member 21 is kept as a straight line. As the arm member 21 is rotated, the fan shaped gear 21*a* is rotated about the rotating shaft 21*b* in the direction of arrow G. Thus, the signal output drum 22 is rotated in the direction of arrow I through the gear 22*d* engaged with the fan shaped gear 21*a*. Thereafter, when the paper rear edge guide 19 is placed in the LET storing position, the "LET protrusion train" is exposed from the window portion 19*ha* of the outside frame 19*a*. When the paper cassette 1 is attached to the printer 2, the train of protrusions 22*b* that is exposed causes the edges of the detecting levers 27*b* and 27*c* corresponding to the protrusions 32*b* to be pressed toward the control plate 25. Thus, the detecting levers 27*b* and 27*c* are rotated about the fulcrum shaft 23*a*. Consequently, the other edges of the detecting levers 27*b* and 27*c* press the switches 26*b* and 26*c*, respectively. The switches 26*b* and 26*c* output signals to the CPU 53 through the I/O port 58. The CPU 53 compares the combination of these signals with the combination of signals stored in a predetermined area of the ROM 54 and determines that the size of the paper stored in the paper cassette 1 is A4.

When papers of A5 size are stored in the paper cassette 1, the paper rear edge guide 19 is further moved to the "A5" storing position in the direction of arrow D. Thus, the link member 20, the arm member 21, and the signal output drum 22 operate in the reverse manner of the above-described operation. Consequently, the "A5 protrusion train" is exposed from the window portion 19*ha* of the outside frame 19*a*. When the paper cassette 1 is attached to the printer 2, the CPU 53 performs the same operation and determines that the size of the papers stored in the paper cassette 1 is A5.

In the first embodiment, since the elliptic protrusion 20*a* having the straight portion 20*b* is formed on the link member 20, when the paper rear edge guide 19 is moved, the relation between the link member 20 and the arm member 21 is always kept as a straight line. In addition, the amount of rotation of the signal output drum 22 corresponding to the storing position of each size of papers is calculated. Thus, when the paper rear edge guide 19 is placed in a desired paper size position and the cassette 1 is attached to the printer 2, the main unit 62 can determine the size of papers stored in the cassette 1.

(Second Embodiment)

In the first embodiment, the elliptic protrusion 20*a* formed on the link member 20 causes the relation between the link member 20 and the arm member 21 to be always kept as a straight line. In the second embodiment, a post formed on the link member 20 is moved along a guide groove formed in the bottom frame of the paper cassette so as to always keep the relation between the link member 20 and the arm member 21 as a straight line.

Next, with reference to FIGS. 2, 3, and 12 to 14, the second embodiment will be described.

Figure 12:
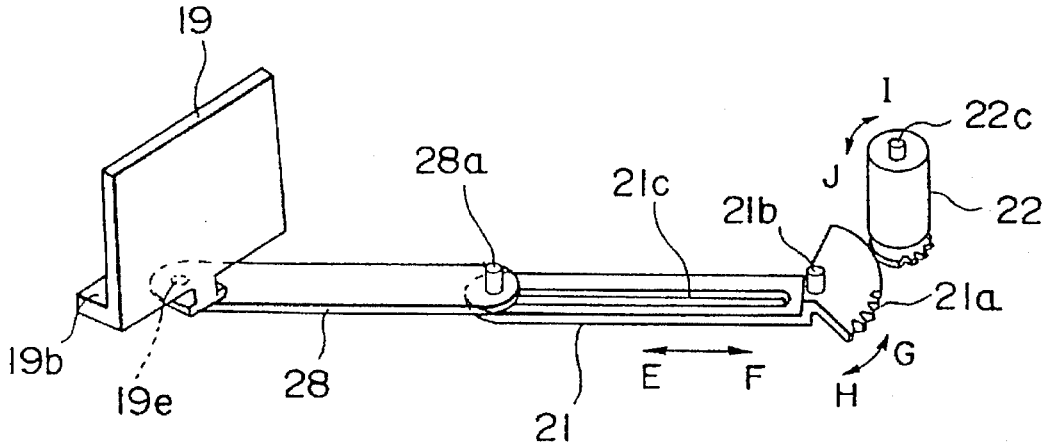
FIG. 12 is an enlarged perspective view showing a connected state between a link member and an arm member according to a second embodiment.
Figure 13:
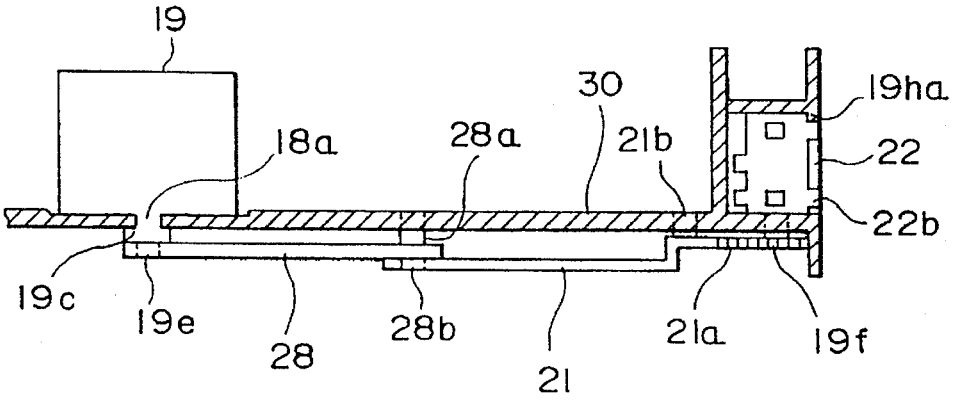
FIG. 13 is a sectional view showing a mounted state of the link member according to the second embodiment.
Figure 14:
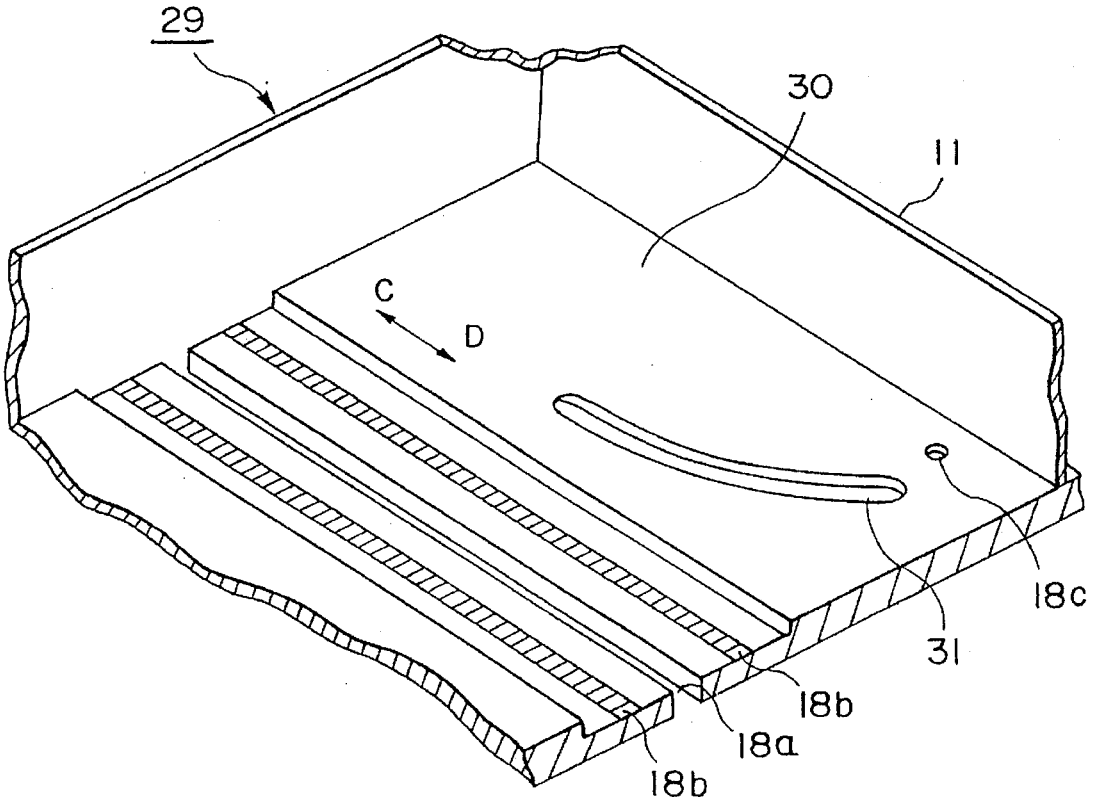
FIG. 14 is a partially enlarged perspective view showing a guide groove formed in a bottom frame of a paper cassette according to the second embodiment.

In FIGS. 12 and 13, an edge of the link member 28 is rotatably fit to a shaft 19*e* disposed on the lower surface of a paper rear edge guide 19*c*. At the other edge of the link member 20, posts 28*a* and 28*b* protrude upwardly on the bottom frame 30 and downwardly on the arm member 21, respectively. The posts 28*a* and 28*b* are slidably fit to a guide groove 31 of the bottom frame 30. When the paper rear edge guide 19 is moved in the directions of arrows C and D, the post member 28*a* is moved along the guide groove 31 of the bottom frame 30. Thus, the relation between the link member 28 and the arm member 21 is always kept as a straight line.

Since the construction of other portions of the second embodiment is the same as that of the first embodiment, the description is omitted.

Figure 15:
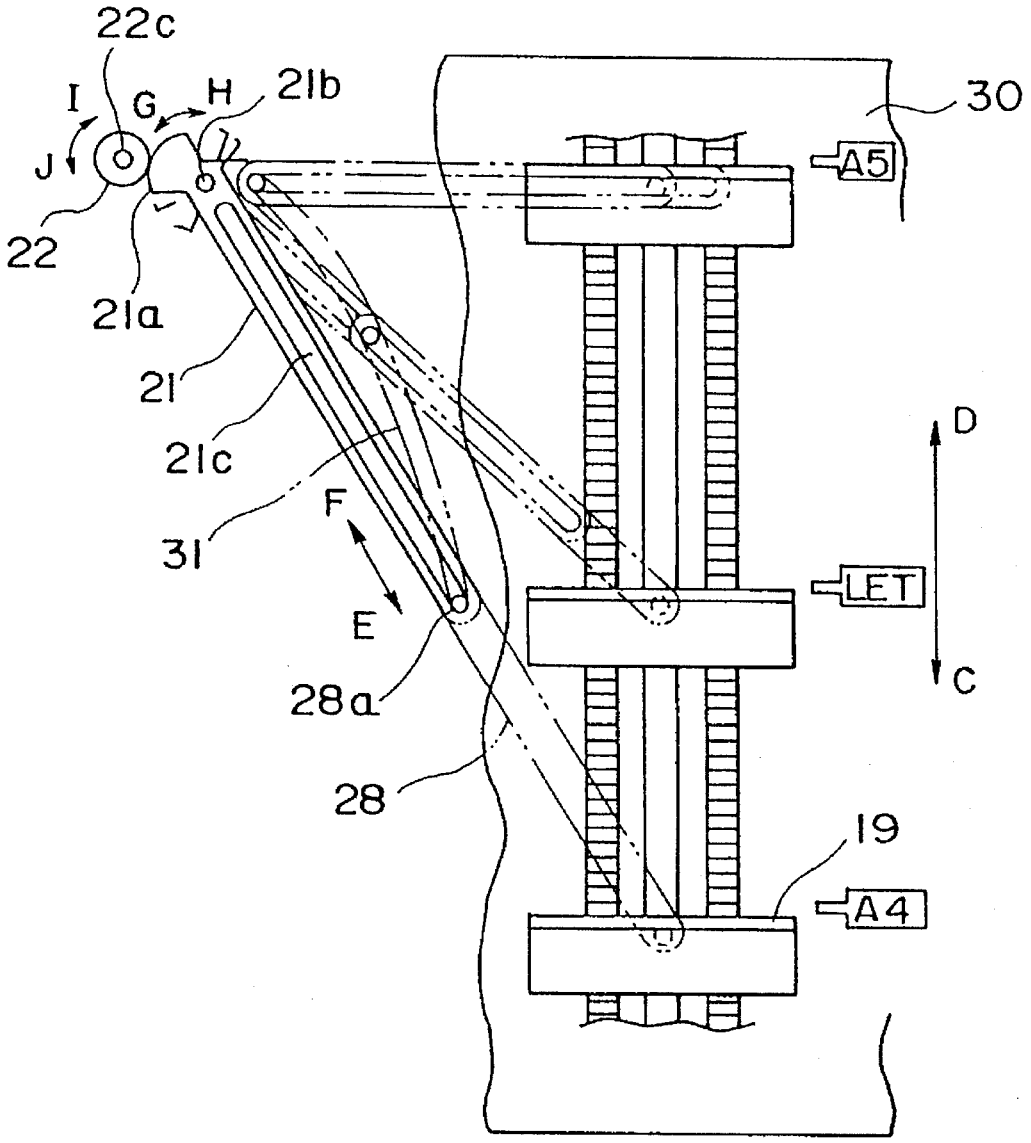
FIG. 15 is a schematic diagram for explaining the operation of a paper rear edge guide according to the second embodiment.
Figure 16:
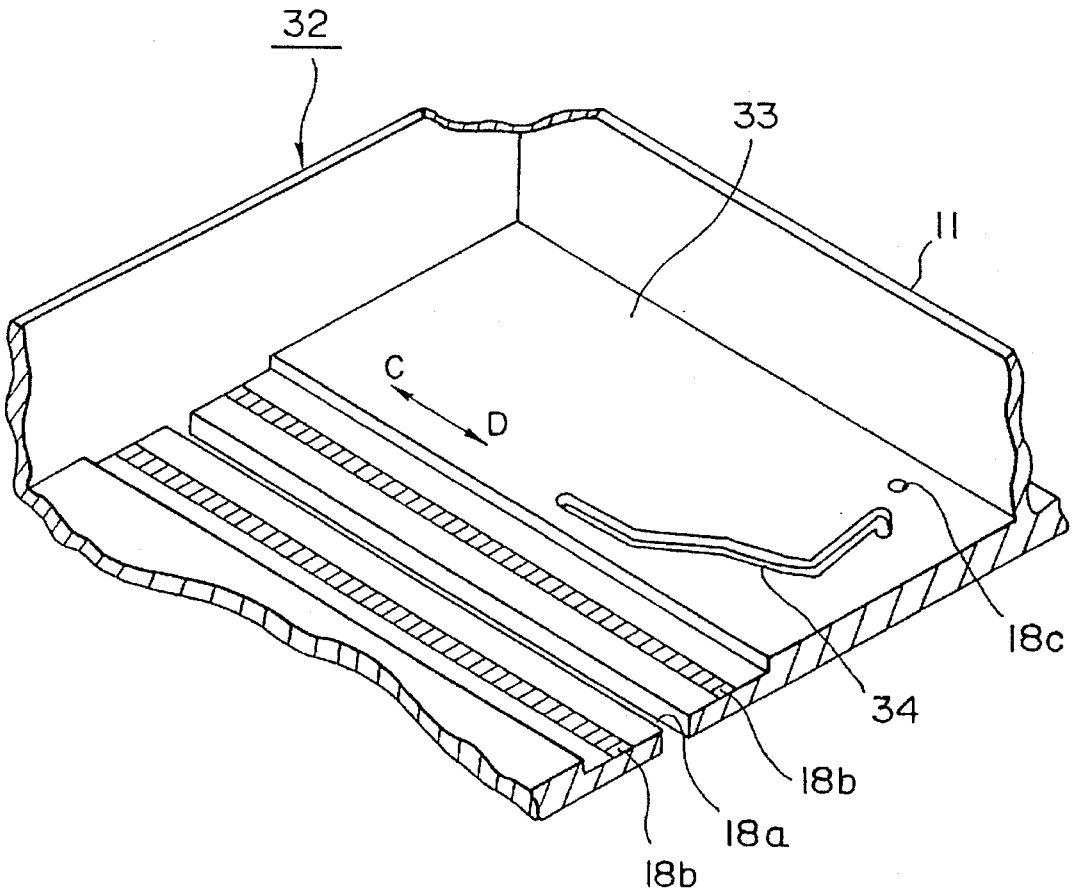
FIG. 16 is a partially enlarged perspective view showing a guide groove formed in a bottom frame according to a third embodiment.

Next, with reference to FIG. 15, the operation for storing papers in the paper cassette will be described. In FIG. 15, when papers are stored in the paper cassette 29 and the paper rear edge guide 19 is moved in the direction of arrow C or D corresponding to the size of the papers, the post 28*a* of the link member 28 is guided to the guide groove 31. In addition, the post 28*b* is moved along the guide groove 21*c* of the arm member 21. At this point, the post 28*b* causes the arm member 21 to be rotated. As the arm member 21 is rotated, the train of the protrusions 22*b* of the signal output drum 22 is exposed from the window portion 19*ha* of the outside frame 19*h*. Thereafter, the paper cassette 29 is attached to the main unit 2.

Since the construction and operation of the mechanism for determining the size of papers stored in the paper cassette 29 in the second embodiment are the same as those of the first embodiment, the description is omitted.

In the first embodiment, to cause the link member 20 and the arm member 21 to stably operate with the relation as a straight line, the length of the straight portion 20*b* of the elliptic protrusion 20*a* should be increased. Thus, in the first embodiment, the elliptic protrusion 20*a* is largely formed. In addition, the length of the guide groove 21*c* of the arm member 21 is determined corresponding to the amount of movement of the paper rear edge guide 19. Since the elliptic protrusion 20*a* is largely formed, the guide groove 21*c* becomes long. In other words, the arm member 21 becomes long. On the other hand, in the second embodiment, since the post 28*a* of the link member 28 is slid in the guide groove 31 of the bottom frame 30, the relation between the link member and the arm member can be always kept as a straight line. Thus, in the second embodiment, it is not necessary to cause the arm member to become long. Consequently, the paper cassette can be compactly formed.

(Third Embodiment)

In the second embodiment, the guide groove 31 is formed on the bottom frame of the paper cassette 29 so that the relation between the link member 20 and the arm member 21 is always kept as a straight line.

However, in the third embodiment, the guide groove 31 is properly bent so as to adjust the amount of rotation of the arm member 21 between adjacent storing positions when the paper rear edge guide is moved.

Next, with reference to FIGS. 2, 3, 16, 17, and 19, the third embodiment will be described.

Figure 17:
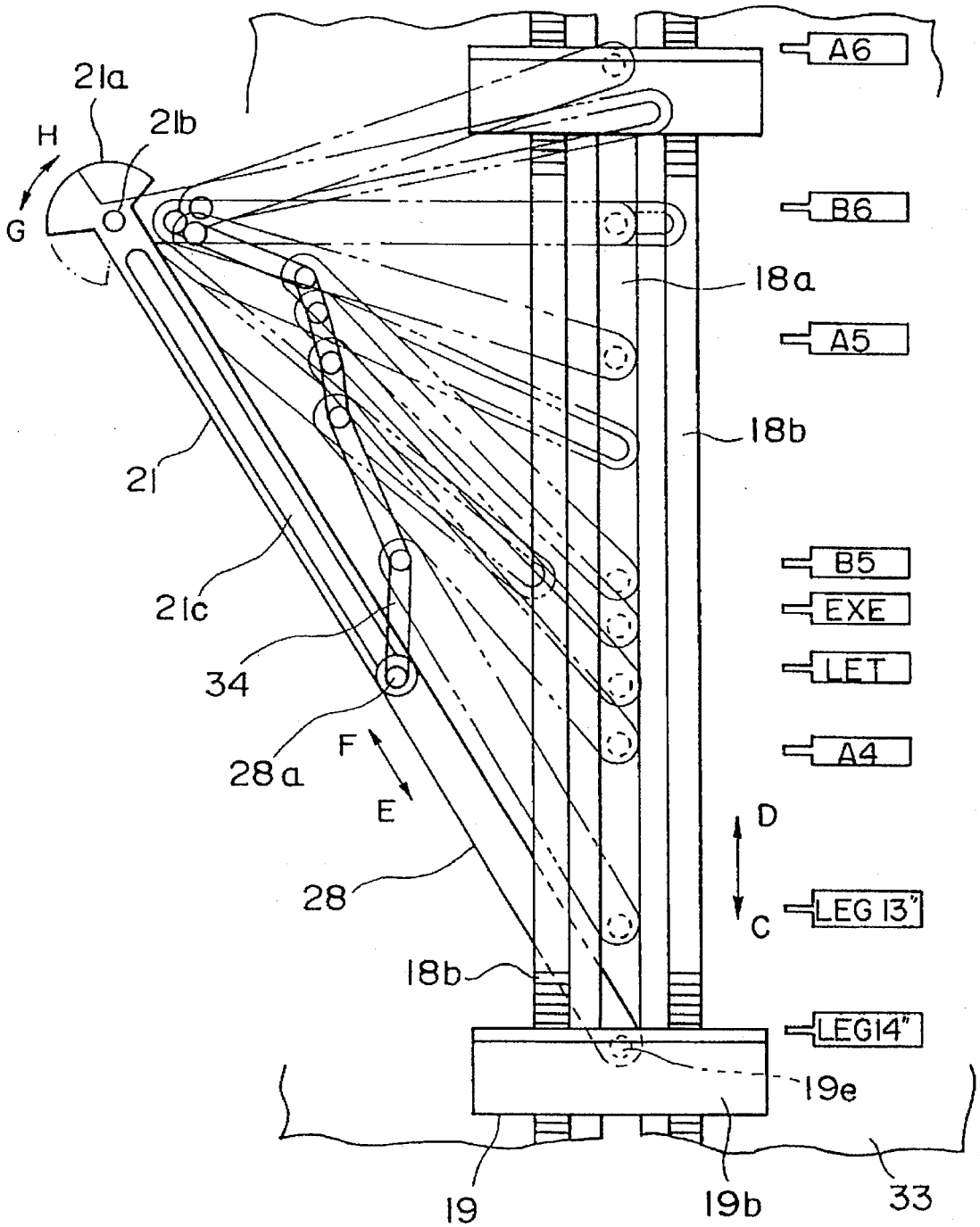
FIG. 17 is a schematic diagram for explaining the operation of a paper rear edge guide according to the third embodiment.

In FIG. 15, a guide groove 34 that is properly bent is formed on the bottom frame 33 of the paper cassette 32. The post 28*a* of the link member 28 is slidably fit to the guide groove 34. As shown in FIG. 17, the paper cassette 32 of the third embodiment can store papers of nine sizes. Thus, nine trains of protrusion (not shown) corresponding to the sizes of papers are formed on the signal detecting drum 22. The guide groove 34 of this embodiment is properly bent so that the amount of rotation of the arm member 21 becomes large in the case that the paper rear edge guide 19 is slightly moved between adjacent paper storing positions. Thus, when the paper rear edge guide 19 is moved, it is possible to prevent the amount of rotation of the signal output drum 22 between adjacent paper storing positions from becoming very small. Consequently, each train of protrusions 22*b* is formed at a predetermined pitch.

Since the construction of the other portions in the third embodiment is the same as that in the second embodiment, the description is omitted.

Next, the operation for storing papers in the paper cassette according to the third embodiment will be described. Since the operation after the paper cassette is attached to the printer in the third embodiment is the same as that in the first embodiment, the description is omitted.

Papers are stored in the paper cassette 32. The paper rear edge guide 19 is moved in the direction of arrow C or D corresponding to the size of the papers. When the paper rear edge guide 19 is moved, the post 28*a* of the link member 28 is guided to the link groove 34. In addition, the post 28 is moved in the direction of arrow F or E along the guide groove 21*c* of the arm member 21. The standardized sizes of papers do not increase or decrease by a predetermined length or width. Thus, in the case that the paper rear edge guide 19 is slightly moved between adjacent paper storing positions, the arm member 21 and the link member 28 are bent and rotated about the post 28*a*.

Figure 18:
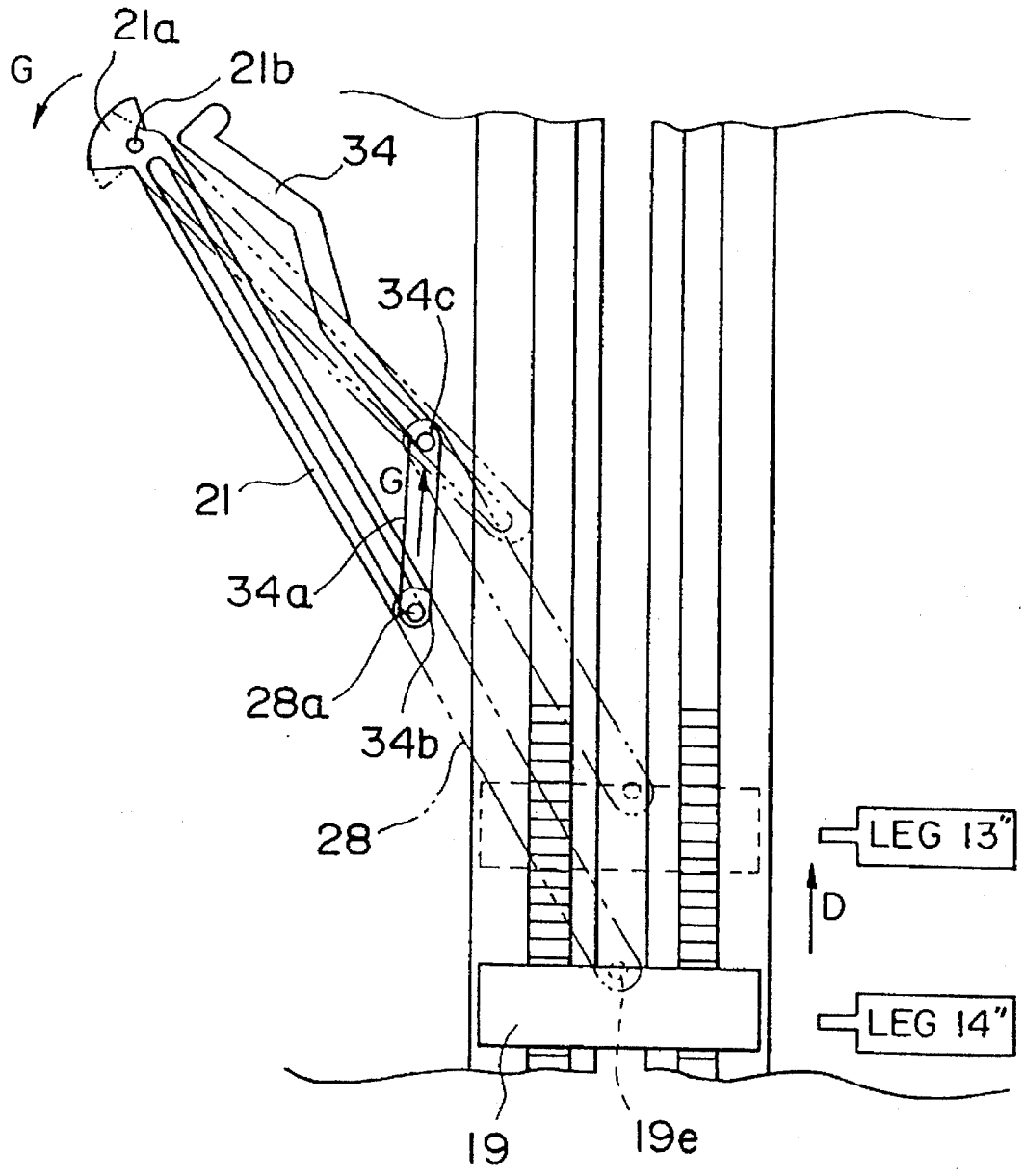
FIG. 18 is a schematic diagram for explaining the operation of a link member and an arm member according to the third embodiment.

Next, with reference to FIG. 18, the operation of each constructional portion in the case that the paper rear edge guide 19 is moved from the regal 14" paper (LEG 14') storing position to the regal 13" paper (LEG 13") storing position will be described.

When the paper rear edge guide 19 is placed in the LEG 14" paper storing position, the post 28 is placed at a portion 34*b* of the guide groove 34. When the post 28 is placed in the portion 34*b* of the guide groove 34, the relation between the link member 28 and the arm member 21 is kept as a straight line. When the paper rear edge guide 19 is moved in the direction of arrow D, the post 28 causes the portion 34*a* of the guide groove 34 to be moved in the direction of arrow G. At this point, the link member 28 and the arm member 21 are gradually bent in the direction of arrow F about the post 28. When the paper rear edge guide 19 is moved to the LEG 13" paper storing position, the post 28 is moved to the portion 34*c* of the guide groove 34. The link member 28 and the arm member 21 are bent about the post 28 as illustrated by a dotted line. Thus, the amount of rotation of the arm member 21 becomes large. As the arm member 21 is rotated, the fan shaped gear 21*a* causes the signal output drum 22 to rotate. When the paper rear edge guide 19 is secured at a paper storing position corresponding to the paper size, the train of protrusions 22*b* of the signal output drum 22 corresponding to the paper size is exposed from the window portion 19*ha* of the outside frame 19*h*. Thereafter, the paper cassette 32 is attached to the main unit 62.

Since the arm member 21 and the link member 28 are bent in the rotating direction in the case that the paper rear edge guide 19 is slightly moved between the adjacent storing positions, the rotation of the arm member 21 becomes large. Thus, it is possible to prevent the pitches of the trains of protrusions on the signal output drum 22 from becoming very small. Consequently, an error detection such as an assembling error due to the dislocation of the protrusions 22*b* can be reduced.

In the third embodiment, when the paper rear edge guide 19 is moved, the guide groove is properly bent so that the amount of rotation of the arm member 21 between adjacent paper storing positions becomes large. However, the guide groove may be properly bent so that the amount of rotation of the arm member 21 between adjacent storing positions becomes equal. Thus, the pitches of the trains of protrusions 22*b* formed on the signal output drum can become equal. Consequently, the signal output drum can be simply fabricated, thereby reducing the cost.

(First Modification)

In the first to third embodiments, the fan shaped gear 21 and the gear 22*d* of the signal output drum 22 are engaged so as to rotate the signal output drum. However, the rotating force of the arm member 21 may be transmitted to the signal output drum 22 using contact friction of for example highly frictional members (rubber or the like). When the rotating shaft 21*b* of the arm member 21 functions as the rotating shaft 22*ca* or 22*cb* of the signal output drum 22, it is not necessary to provide the fan shaped gear 21*a* and the gear 22*d*. Thus, in this case, the number of constructional portions can be reduced.

(Second Modification)

In the first to third embodiments, the signal output drum 22 is used. However, instead of the signal output drum 22, a flat signal output plate may be used.

Figure 19:
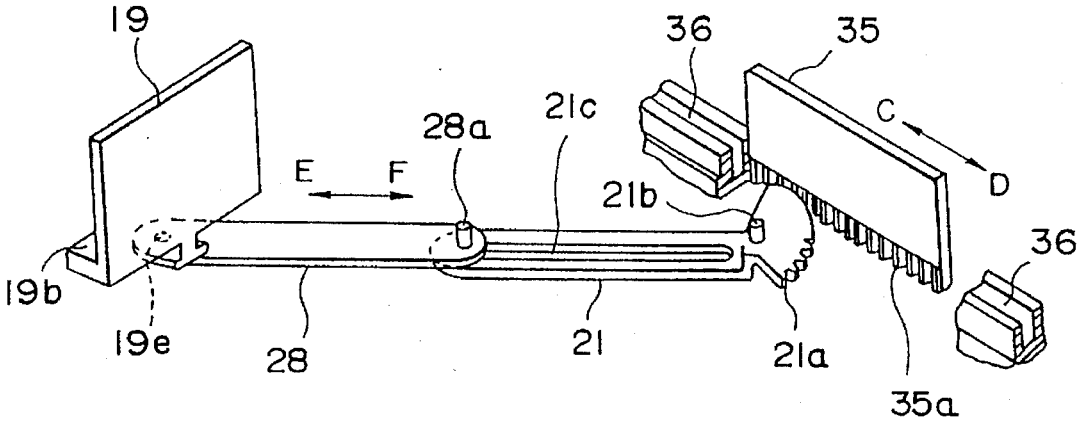
FIG. 19 is an enlarged perspective view showing a connected state between a signal detecting plate and an arm member disposed on a paper cassette according to a second modification.
Figure 20:
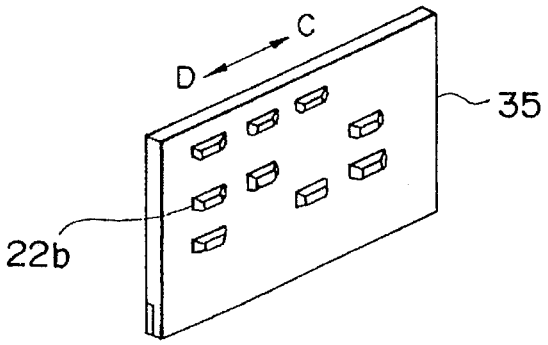
FIG. 20 is a perspective view showing a train of protrusions formed on a signal detecting plate according to the second modification.

In FIGS. 19 and 20, a rack 35*a* is integrally formed on a surface of the signal output plate 35 so that the rack 35*a* is engaged with the fan shaped gear 21*a*. In addition, as shown in FIG. 20, trains of protrusions are formed on the rear surface of the rack 35*a*. The signal output plate is slidably engaged with a guide groove 36 formed on a paper cassette frame (not shown). When the paper rear edge guide 19 is moved, the link member 28 causes the arm member 21 to rotate. Thus, the fan shaped gear 21*a* causes the signal output plate 35 to move in the directions of arrows C and D and thereby the corresponding train of protrusions to come in contact with the detecting lever 27.

In the second modification, the link member 28 of the second and third embodiments is used. However, the second modification can be applied for the paper cassette of the first embodiment. The number of protrusions 22*b* can be increased or decreased corresponding to the number of sizes of papers.

In the first to third embodiments and the first and second modifications, an electrophotographic printer was described. However, the present invention is not limited to such a printer. In other words, the present invention can be applied for an apparatus to which a paper cassette is attached.

In the first to third embodiments and the first and second modifications, the linear moving motion of the paper rear edge guide 19 is converted into the rotating motion of the arm member 21 by the link member so as to keep the pitches of the trains of protrusions 2*b* and the switches constant. In addition, the detection levers 27 are disposed between the protrusions 22*b* and the switches 26 that are disposed at constant pitches. Thus, the pressing force of the switches 26 is kept constant. Consequently, the malfunction of the switches can be reduced. As a result, the sizes of papers can be precisely determined.

In the first to third embodiments and the first and second modifications, the protrusions 22*b* press the switches 26 through the detecting levers 27. Instead, magnet members may be disposed at the protrusions 22*b*. Moreover, instead of the switches 26, Hall devices may be disposed on the control plate 25. Thus, the magnet members and the Hall devices output signals in noncontact state. Consequently, the malfunction due to wearing of the switches can be prevented.

In the first to third embodiments and the first and second modifications, the link member is disposed on the paper rear edge guide 19. However, since the widths of standardized papers are predetermined, the link member is disposed on the paper side guides 15*a* and 15*b*. Thus, as the paper side guides 15*a* and 15*b* are moved, the arm member 21 can be rotated.

Although the present invention has been shown and described with respect to best mode embodiments thereof, it should be understood by those skilled in the art that the foregoing and various other changes, omissions, and additions in the form and detail thereof may be made therein without departing from the spirit and scope of the present invention.

What is claimed is:

1. A paper cassette, comprising:

a frame for stacking papers;

a paper guide movably mounted at said frame corresponding to the size of the stored papers;

a signal output portion; and transmitting means for transmitting the position of said paper guide to said signal output portion, wherein said signal output portion is adapted for outputting a paper size signal corresponding to the stored papers corresponding to position information of said paper guide transmitted by said transmitting means, wherein said paper guide is linearly movable, said transmitting means being a link mechanism for converting the linear motion of said, paper guide into a rotating motion and for transmitting the rotating motion to said signal output portion, and wherein a plurality of trains of protrusions are formed on a surface of said signal output portion and said signal output portion is adapted for outputting the size of the stored papers corresponding to a train of protrusions selected corresponding to the position information of said paper guide transmitted by said transmitting means.

2. The paper cassette as set forth in claim 1, wherein said transmitting means includes an arm member pivotably mounted on the frame, a fan shaped gear positioned at one end of the arm member, and a link member coupling the arm member and the paper guide such that movement of the paper guide pivots the arm member and moves the fan shaped gear, wherein said signal output portion includes a rotatable signal output drum and a drive gear, the surface of the signal output portion being a peripheral surface of the drum, and wherein said drive gear and said fan shaped gear are engaged with each other, said signal output drum being rotated corresponding to the rotation of said arm member, one train of protrusions being selected corresponding to the size of papers stored in said paper cassette, the size of papers being output corresponding to the selected train of protrusions.

3. The paper cassette as set forth in claim 1, wherein the transmitting means includes an arm member pivotably mounted on the frame, a fan shaped gear positioned at one end of the arm member, and a link member coupling the arm member and the paper guide such that movement of the paper guide pivots the arm member and moves the fan shaped gear, wherein said signal output portion includes a slidable plate and a rack, the surface of the signal output portion being an outer surface of the plate, said rack being adapted for sliding said plate, and wherein said rack and said fan shaped gear are engaged with each other, said plate being slid corresponding to the rotation of said arm member, one train of protrusions being selected corresponding to the size of papers stored in said paper cassette, the size of papers being output corresponding to the selected train of protrusions.

4. A paper cassette, comprising:

a frame for stacking papers;

a paper guide movably mounted at said frame corresponding to the size of the stored papers;

a signal output portion; and transmitting means for transmitting the position of said paper guide to said signal output portion, wherein said signal output portion is adapted for outputting a paper size signal corresponding to the stored papers corresponding to position information of said paper guide transmitted by said transmitting means, wherein said paper guide is linearly movable, said transmitting means being a link mechanism for converting the linear motion of said paper guide into a rotating motion and for transmitting the rotating motion to said signal output portion, and wherein a plurality of trains of magnet members are formed on a surface of said signal output portion and said signal output portion is adapted for outputting the size of the stored papers corresponding to a train of magnet members selected corresponding to the position information of said paper guide transmitted by said transmitting means.

5. A paper cassette, comprising:

a frame for stacking papers;

a paper guide movably mounted at said frame corresponding to the size of the stored papers;

a signal output portion; and transmitting means for transmitting the position of said paper guide to said signal output portion, wherein said signal output portion as adapted for outputting a paper size signal corresponding to the stored papers corresponding to position information of said paper guide transmitted by said transmitting means, wherein said paper guide is linearly movable, said transmitting means being a link mechanism for converting the linear motion of said paper guide into a rotating motion and for transmitting the rotating motion to said signal output portion, wherein said transmitting means comprises:

an arm member rotatably pivoted; and a link member having a first edge and a second edge, the first edge being rotatably pivoted by said paper guide, the second edge being movably connected in the longitudinal direction of said arm member corresponding to the movement of said paper guide, the arm member being rotated corresponding to the movement of said paper guide, and wherein the position of said paper guide is transmitted to said signal output portion corresponding to the rotation of said arm member.

6. The paper cassette as set forth in claim 5, wherein said arm member and said link member are connected so that the relation thereof is always kept as a straight line.

7. The paper cassette as set forth in claim 5, wherein said link member has a post at a second edge thereof, wherein said arm member has a guide narrow groove for movably guiding said post in the longitudinal direction of said arm member, and wherein a guide groove is formed in said frame of said paper guide and adapted for guiding a post and rotating the arm member around the post with respect to the link member when said paper guide is moved so that the amount of rotation of said arm member between adjacent paper storing positions of said paper guide exceeds a predetermined amount.

8. The paper cassette as set forth in claim 7, wherein a plurality of trains of magnet members are formed on a surface of said signal output portion and said signal output portion is adapted for outputting the size of the stored papers corresponding to a train of magnet members selected corresponding to the position information of said paper guide transmitted by said transmitting means.

9. The paper cassette as set forth in claim 7, wherein a plurality of trains of protrusions are formed on a surface of said signal output portion and said signal output portion is adapted for outputting the size of the stored papers corresponding, to a train of protrusions selected corresponding to the position information of said paper guide transmitted by said transmitting means.

10. The paper cassette as set forth in claim 9, wherein said signal output portion includes a rotatable signal output drum and a drive gear, the surface of the signal output portion being a peripheral surface of the drum, said drive gear being adapted for driving said signal output drum, wherein said arm member includes a fan shaped gear formed at one edge thereof, and wherein said rive gear and said fan shaped gear are engaged with each other, said signal output drum being rotated corresponding to the rotation of said arm member, one train of protrusions being selected corresponding to the size of papers stored in said paper cassette, the size of papers being output corresponding to the selected train of protrusions.

11. The paper cassette as set forth in claim 9, wherein said signal output portion includes a slidable plate and a rack, the surface of the signal output portion being an outer surface of the plate, said rack being adapted for sliding said plate, wherein said arm member includes a fan shaped gear formed at one edge thereof, and wherein said rack and said fan shaped gear are engaged with each other, said plate being slid corresponding to the rotation of said arm member, one train of protrusions being selected corresponding to the size of papers stored in said paper cassette, the size of papers being output corresponding to the selected train of protrusions.

12. A printer, comprising:

a paper cassette for storing papers;

paper feed means for feeding papers stored in said paper cassette; and a printing unit for printing data on the papers, wherein said paper cassette comprises:

a frame for stacking the papers;

a paper guide movably disposed on said frame at a position corresponding to the size of the paper stored in said paper cassette;

a signal output portion; and transmitting means for transmitting the position of said paper guide to said signal output portion, wherein said signal output portion is adapted for outputting a paper size signal corresponding to the stored papers corresponding to position information of said paper guide transmitted by said transmitting means, wherein said printing unit comprises;

signal detecting means for detecting the paper size signal that is output from said signal output portion when said paper cassette is attached to said printing unit; and determining means for determining the size of the papers stored in said paper cassette corresponding to the signal detected by said signal detecting means, wherein said paper guide is linearly movable, said transmitting means being a link mechanism for converting the linear motion of said paper guide into a rotating motion and for transmitting the rotating motion to said signal output portion, wherein a plurality of trains of protrusions are formed on a surface of said signal output portion and said signal output portion is adapted for outputting the size of the stored papers corresponding to a train of protrusions selected corresponding to the position information of said paper guide transmitted by said transmitting means, and wherein said signal detecting means includes a switch driven by one of trains of protrusions selected corresponding to position information of said paper guide transmitted by said transmitting means when said paper is attached to said printing unit.

13. A printer, comprising:

a paper cassette for storing papers;

paper feed means for feeding papers stored in said paper cassette; and a printing unit for printing data on the papers, wherein said paper cassette comprises:

a frame for stacking the papers;

a paper guide movably disposed on said frame at a position corresponding to the size of the paper stored in said paper cassette;

a signal output portion; and transmitting means for transmitting the position of said paper guide to said signal output portion, wherein said signal output portion is adapted for outputting a paper size signal corresponding to the stored papers corresponding to position information of said paper guide transmitted by said transmitting means, wherein said printing unit comprises;

signal detecting means for detecting the paper size signal that is output from said signal output portion when said paper cassette is attached to said printing unit; and determining means for determining the size of the papers stored in said paper cassette corresponding to the signal detected by said signal detecting means, wherein said paper guide is linearly movable, said transmitting means being a link mechanism for converting the linear motion of said paper guide into a rotating motion and for transmitting the rotating motion to said signal output portion, wherein a plurality of trains of magnet members are formed on a surface of said signal output portion and said signal output portion is adapted for outputting the size of the stored papers corresponding to a train of magnet members selected corresponding to the position information of said paper guide transmitted by said transmitting means, and wherein said signal detecting means includes a Hall device driven by one of trains of magnet members selected corresponding to position information of said paper guide transmitted by said transmitting means when said paper is attached to said printing unit.

* * * * *